United States Patent [19]

Komeda et al.

[11] Patent Number: 4,978,129

[45] Date of Patent: Dec. 18, 1990

[54] ELECTRONIC GAME APPARATUS

[75] Inventors: Kenichiro Komeda, Gose; Kenichi Inui, Yamatokoriyama, both of Japan

[73] Assignee: Sharp Kabushiki Kaisha, Osaka, Japan

[21] Appl. No.: 226,520

[22] Filed: Jul. 29, 1988

Related U.S. Application Data

[63] Continuation of Ser. No. 471,355, Mar. 2, 1983, abandoned.

[30] Foreign Application Priority Data

Mar. 3, 1982 [JP] Japan ..... 57-34371

[51] Int. Cl.[5] ..... A63F 9/00

[52] U.S. Cl. ..... 273/237; 273/1 E; 273/85 G; 434/201

[58] Field of Search ..... 434/201; 273/237, 85 G, 273/1 E, DIG. 28

[56] References Cited

U.S. PATENT DOCUMENTS 3,787,988 1/1974 Nakajima et al. ..... 434/201

*Primary Examiner*—William H. Grieb

[57] ABSTRACT

An electronic game apparatus effects a right shift or a left shift of an entire display of multiple randomly arranged numerals or symbols, and exchange of specified displayed digits of numerals or symbols. The electronic game apparatus can arrange and shift the rows of numerals or symbols displayed on the display means into a prescribed order.

8 Claims, 3 Drawing Sheets

ELECTRONIC GAME APPARATUS

This application is a continuation, of application Ser. No. 06/471/355 filed on March 2, 1983, now abandoned.

BACKGROUND OF THE INVENTION

The present invention relates to an electronic game apparatus, for example, a game calculator and the like, that enables the user to enjoy games.

A number of original games utilizing microcomputers have recently been developed and applied to a variety of video games, game machines and educational aids, with the trend being to incorporate these devices into calculators and watches.

OBJECT AND SUMMARY OF THE INVENTION

Accordingly, an object of the present invention is to provide an improved electronic game apparatus for selectively shifting display digits.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

According to one embodiment of the present invention, an electronic game calculator comprises a display means having multiple digits, and means for shifting to the right and to the left a chain or row of randomly arranged numerals or symbols on the abovementioned display means, and a means for interchanging specific digits of the now including numerals or symbols arranged randomly on the abovementioned display means.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
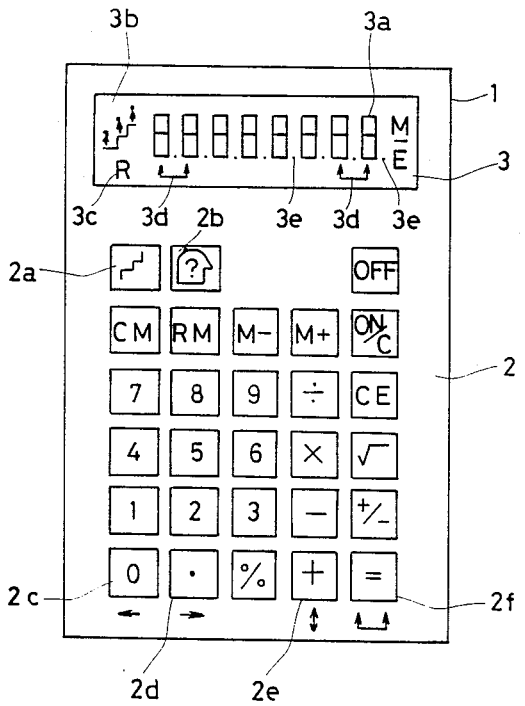
FIG. 1 is a perspectine view of one embodiment of an electronic game calculator according to the present invention.

FIG. 1 is an exterior view of one embodiment of an electronic game calculator according to the present invention.

This electronic game calculator comprises a display section 3, for example, an 8-digit display, and a keyboard 2 including a number of keys.

The keyboard 2 is provided with numeral keys (0 to 9), a decimal point key, some function keys, and some keys actuated to play a game.

In this embodiment of the present invention, a game course set key 2*a* can be operated to select among three step courses, A, B, and C.

This key 2*a* is actuated to select a particular arrangement of random numerals or symbols.

For example, in this embodiment of the present invention, A course is a game in which the object is to select a particular arrangement of 11223344. By the selection of B course, the game should end up with the particular arrangement of 12341234, and by the selection of C course, the game should end up with a further arrangement of 1122334455667788.

A game start key 2*b*, is depressed to start a game in conformance with the above courses, and displacement keys, which are discussed later, can be operated as game keys.

In the calculation mode, a key 2*c* is the "0" key, while in the game mode it operates as a left shift key.

A key 2*d* is the decimal point key in the calculation mode, while in the game mode it operates as a right shift key.

A key 2*e* is the plus (+) key in the calculation mode, while in the game mode, in the case where the C course is selected by the course set key 2*a*, this key 2*e* is acturated to select an alternate display which appears only during the period when the key 2*e* is continuously depressed.

In the C course, 16 digits must be displayed. However, the 8 digit display cannot display them simultaneously. Therefore, the initial 8 digits are displayed in the 8 digit display and the last 8 digits are reserved in a memory.

The alternate display is a display the latter 8 digits in the 8 digits display of in place of the first eight digits.

A key 2*f* is an equal (=) key in the calculation mode while in the game mode it acts as the exchange key.

A portion 3*a* is a seven segment which displays numerals or symbols.

A course indicator 3*b* displays a human figure and a staircase, and represents, with the position of the human figure, A course where the human figure is positioned at the first step, B course where the human figure is positioned at the second step, and C course the human figure is positioned at the third step.

However, in the calculation mode, the human figure and the staircase disappear.

An alternate display indicator 3*c* light up in C course only during the period when the alternate display key 3*e* is being depressed.

A symbol 3*d*, activated by the exchange key 2*f*, indicates interchanged digits, and, during the game, is continually illuminated, but is turned off in the calculation mode.

A symbol 3*e* is the decimal point while the calculator is operated in the calculation mode, but during a game, counts the time before any key is actuated. Approximately every 2 seconds the decimal shifts one space from the right end in the manner of 1,2,3, . . . 8. During this interval, if none of the left shift key, the right shift key or the exchange key is acturated, the index (number of key inputs) is automatically incremented by a count. In other words, after about a 16 second interval, if there is not one key input, the index is incremented by a count, and this action is repeated every 16 seconds. If there is an effective key input, the timer is cleared, and the decimal point moves back to only one display point from the right end.

Figure 2:
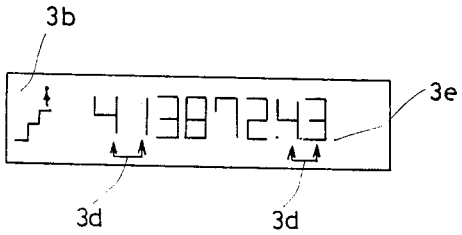
FIG. 2 is shows display contents during the course of a game according to the present invention.

FIG. 2 shows the display during the course of a game in which the C course has been selected, and the arrow mark of the symbol 3*d* indicates two digits which can be exchanged with each other. Thus an 8 digit row of random numerals is prepared.

Here, if the alternate display key 2*e* is depressed, the second 8 digits are displayed.

Figure 3:
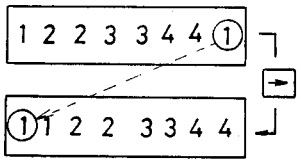
FIG. 3 (1) to FIG. 3 (4) show the relationship between the display and the action of each displacement key.
Figure 3:
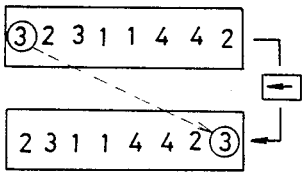
Figure 3:
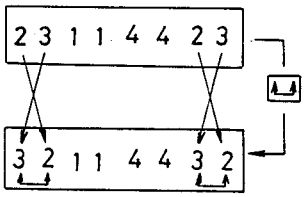
Figure 3:
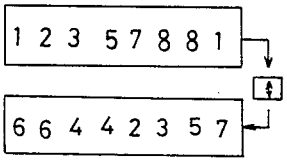

FIG. 3 (1) to FIG. 3 (4) show the relationship between the display and the action of each displacement of key.

(1) Right shift key 2*d* (See FIG. 3 (1))

If the right shift key 2*d* is operated, the entire row of numerals shifts to the right, and the first number from the right is moved to the left end of the row.

(2) Left shift key 2*c* (See FIG. 3 (2))

On the operation of the left shift key 2*c*, the entire row of figures is moved to the left, and the first digit from the left is moved to the right end of the row.

(3) Exchange key 2*f* (See FIG. 3 (3))

On the operation of the exchange key 2*f*, the first digit and in the second digit from the left end are exchanged each other, and the seventh and the eighth digits are exchanged.

(4) Alternate display key 2*e*

While the device is set for the course C, on depressing the alternate display key 2*e*, the first half of the 16 figures 12357881, and the later half 66442357 are exchanged with each other and displayed.

The above explanation gives the basic action of the game, and the following is a concrete example of the progression of the game.

First of all, the course key 2*a* is operated to designate which configuration of figures will be displayed. In this example, the game is to end up with 11223344, and the progress of the game is as follows.

Game start key 2*b* is activated . . . (game start)

(1) 3 3 4 1 4 2 1 2

(Right shift)

(2) 2 3 3 4 1 4 2 1

(Right shift)

(3) 1 2 3 3 4 1 4 2

(Right shift)

(4) 2 1 2 3 3 4 1 4

(Exchange)

(5) 1 2 2 3 3 4 4 1

(Right shift)

(6) 1 1 2 2 3 3 4 4

(7) 1 1 2 2 3 3 4 4 Light turned on and off (Finished)

The display or light is turned on and off at the designated last configuration, and after that the index (the number of key inputs) is displayed, and the game is over. Furthermore, even with 16 digits, the game will progress with the same actions. In addition, the an interesting element of game is that after the game begins, after, about a 16 second interval, if none of the left shift, right shift, or exchange key is operated, the dispslay or index (the number of key inputs) is incremented by one.

The symbols 3*e* light up successively about every 2 seconds, indicating the passage of time.

EXAMPLE 3 3 4 1 4 2 1 2.
2 seconds
3 3 4 1 4 2 1.2.
2 seconds
3 3 4 1 4 2.1.2.
16 seconds
3.3.4.1.4.2.1.2.

In this way, it is possible to offer an electronic game calculator in which the parts which act as the key input section and the display section during calculation, serve as the display and the game key input section, including displacement deys, during the game mode.

Figure 4:
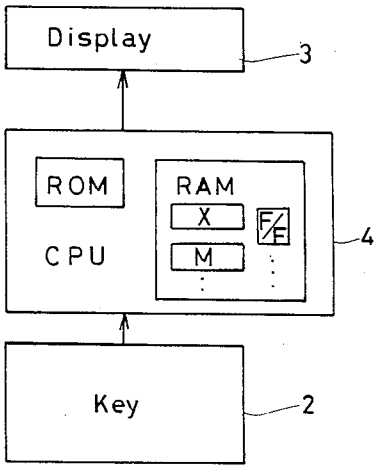
FIG. 4 is a block diagram showing the system configuration of the abovementioned embodiments of the electronic game calculator.

FIG. 4 schematically shows the system configuration of one embodiment of an electronic game calculator according to the present invention.

In the diagram, a one-chip microcomputer 4 includes a CPU (central processing unit), a ROM (read only memory), and a RAM (random access memory).

the ROM contains the programs for the electronic calculator function and for the game function.

The RAM is used as the calculator registers, the memory, and flip-flops in the calculation mode, and as the problem memory and index counter for counting the number of the key operations in the game mode.

Figure 5:
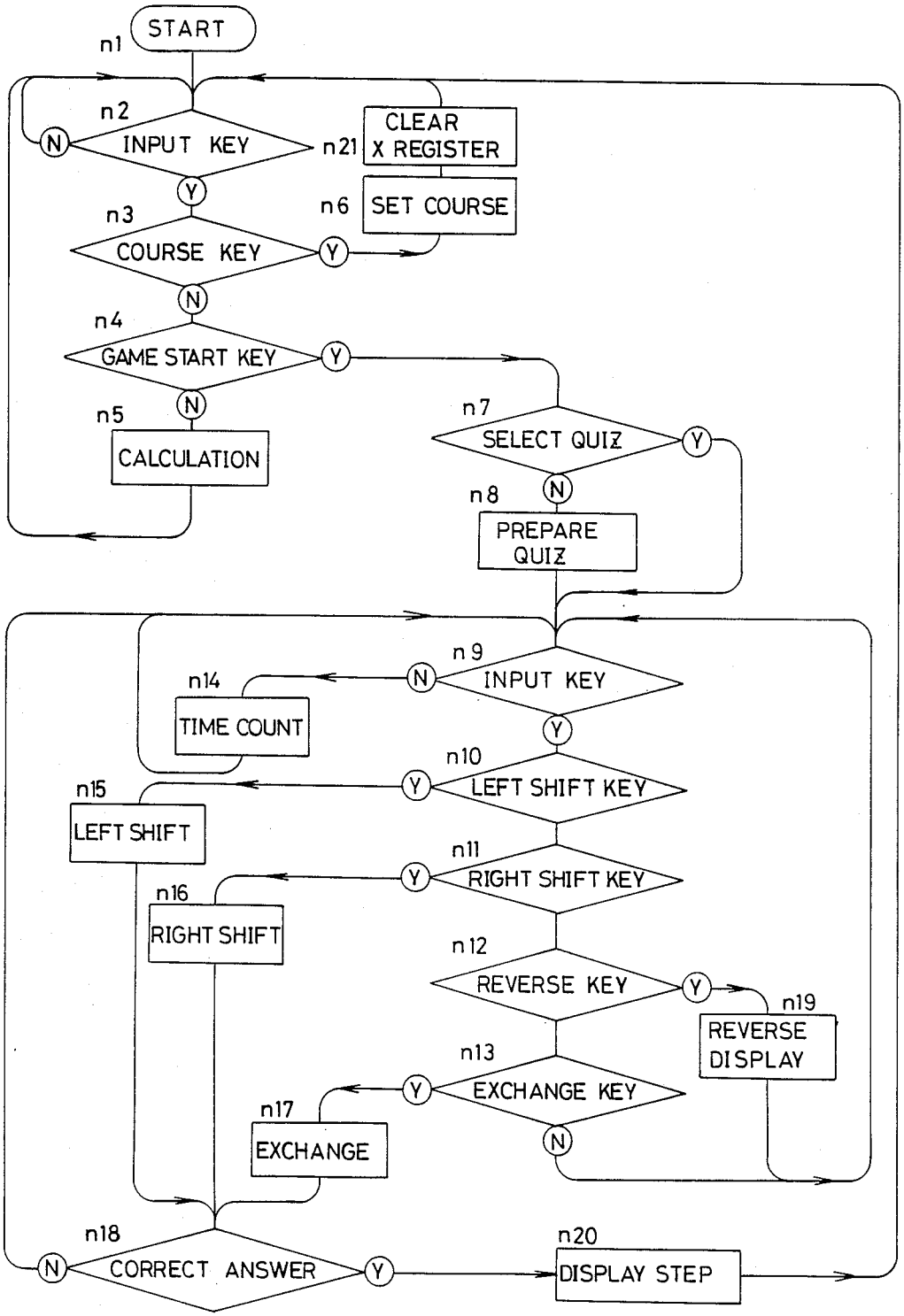
FIG. 5 is a flowchart explaining the operation of that system.

FIG. 5 is a flowchart explaining the operation of the present invention. In step $n_1$, initialization and register clearance are carried out in the calculation mode. In step $n_2$, key input takes place.

Here, if there is no key input in the interval of about 7 minutes, an automatic off function is enabled and the power is automatically switched off.

When the keys relating to electronic calculations are depressed, the sequence of operation goes from step $n_2 \rightarrow n_3 \rightarrow n_4 \rightarrow n_5$, to perform calculations. The step $n_2$ is reselected after the calculation result is displayed.

In the case where the game course key is operated, the sequence selects step $n_2 \rightarrow n_3 \rightarrow n_6$, and one of the courses is selected. In addition, at step $n_{21}$, the X-register is cleared, but in the case where the contents of the X-register are relevant to the A and B course quizzes of the game (11223344 arrangement), then clearance does not take place.

On pushing the game start key 2*b*, the sequence $n_2 \rightarrow n_3 \rightarrow n_4 \rightarrow n_7$ takes place, and the decision is made as to whether the quiz, or sequence of numbers, is already set.

If, in the A and B courses, an appropriate quiz or sequence is entered by keys, that quiz is adopted for the game.

However, if any quiz is not set with A and B course, or if the game is set in the C course, step $n_8$ is executed, then a quiz is prepared using relevant random numbers.

Step $n_9$ is for key input in the game mode, and in the period when there is no key input, the loop $n_9 \rightarrow n_{14} \rightarrow n_9$ is executed. By this loop, the time count is performed, and about every 2 seconds an additional decimal point appears in sequence from the right end to the left end of the display. If the display shows up 8 decimal points and there is no input, the index (the number of key inputs) is incremented by 1. In other words, even if there is no key input, the index is automatically incremented about every 16 seconds.

During the game the self power-off function does not operate.

On depressing the left shift key, the sequence $n_9 \rightarrow n_{10} \rightarrow n_{15}$ progresses, resulting in the left shift. When the right shift key is operated, the right shift results from the sequence $n_9 \rightarrow n_{10} \rightarrow n_{11} \rightarrow n_{16}$.

Depression of the exchange key selects the sequence $n_9 \rightarrow n_{10} \rightarrow n_{11} \rightarrow n_{12} \rightarrow n_{13} \rightarrow n_{17}$, and numerals or symbols are exchanged with each other.

By each operation of the left shift, right shift, and exchange keys, the timer is cleared, the decimal point display returns to the right end lamp only, and the index is incremented by 1.

In step $n_{18}$ the decision is made as to whether or not the correct answer (final form) has resulted. If not, the program returns to step $n_9$, and the game continues. If the correct answer has been obtained, the program proceeds to step $n_{20}$, the index (the number of key inputs) is displayed, and the program returns to step $n_2$.

In this event, because the course set has not been cleared, if the game start key 2b is operated immediately after step $n_2$, the game can proceed on the same course.

However, if the game is over, everything in the electronic calculator registers is cleared, with the exception of memory.

When the alternate display key 2e is depressed, steps $n_9 \rightarrow n_{10} \rightarrow n_{11} \rightarrow n_{12} \rightarrow n_{19}$ proceed in sequence, and, in the case of the C course only, the usual display does not appear, but, instead the later 8 digits are displayed.

The reverse display key is effective only when this key is continuously depressed. When it is released, the initial display returns.

The alternate display key is ineffective in any course but the C course, and the time remains counted.

The invention thus being described, it will be obvious that the same may be varied in many ways. Such variations are not to be regarded as a departure from the spirit and scope of the invention, and all such modifications are intended to be included within the scope of the following claims.

What is claimed is:

1. An electronic game apparatus comprising:

display means for displaying a row comprising a plurality of symbols;

a right-shift input switch and means responsive thereto for effecting a right shift of the entire row of symbols in said display means;

a left-shift input switch and means responsive thereto for effecting a left shift of the entire row of symbols in said display means; and an exchange input switch and means responsive thereto for exchanging specific symbols in the row of symbols displayed in said display means;

wherein said display means further comprises at least one exchange indicator for indicating which symbols of said plurality of symbols will be exchanged in response to actuation of said exchange input switch.

2. An electronic game apparatus comprising:

display means for displaying a row comprising a plurality of symbols;

a right-shift input switch and means responsive thereto for effecting a right shift of the entire row of symbols in said display means;

a left-shift input switch and means responsive thereto for effecting a left shift of the entire row of symbols in said display means; and an exchange input switch and means responsive thereto for exchanging specific symbols in the row of symbols displayed in said display means;

wherein said display means further comprises a plurality of time indicators, said apparatus further including timing means for actuating said time indicators sequentially to indicate passage of time.

3. An electronic game apparatus as in claim 2, further comprising counting means for maintaining a count of key actuations in the course of a game, wherein said counting means is responsive to said timing means for incrementing said count upon passage of a predetermined time interval between sequential key actuations during a game.

4. An electronic game apparatus comprising:

display means for displaying a row comprising a plurality of symbols;

a right-shift input switch and means responsive thereto for effecting a right shift of the entire row of symbols in said display means;

a left-shift input switch and means responsive thereto for effecting a left shift of the entire row of symbols in said display means;

an exchange input switch and means responsive thereto for exchanging specific symbols in the row of symbols displayed in said display means; and counting means for maintaining a count of key actuations in the course of a game.

5. An electronic game apparatus comprising:

display means having a display capacity of a first number of digits for displaying a row of numerals;

a right-shift input switch and means responsive thereto for effecting a right shift of said row of numerals in said display means;

a left-shift input switch and means responsive thereto for effecting a left shift of said row of numerals in said display means;

an exchange input switch and means responsive thereto for exchanging specific numerals in said row of numerals displayed in said display means; and an alternate-display input switch and means responsive thereto for alternately displaying on said display means a first row portion of numerals or a second row portion of numerals, the total number of digits in said first and second row portions being greater than the capacity of said display means.

6. An electronic game apparatus as in claim 5, wherein said first row portion is normally displayed by said display means and said second row portion is displayed by said display means during actuation of said alternate-display input switch.

7. An electronic game apparatus as in claim 5, further comprising a memory for storing data representing said second row portion or said first row portion when said first row portion or said second row portion, respectively, is displayed in said display means.

8. An electronic apparatus as in claim 5, wherein said numerals of said row are initially randomly arranged in said display means.

* * * * *